United States Patent [19]

Laing et al.

[11] Patent Number: 4,963,455

[45] Date of Patent: Oct. 16, 1990

[54] DEVELOPER COMPOSITIONS WITH SUSPENSION POLYMERIZED STYRENE BUTADIENE RESINS

[75] Inventors: John R. Laing, Rochester; Hui Chang, Pittsford; Richard D. Manca, Fairport; Angelo J. Barbetta, Penfield, all of N.Y.

[73] Assignee: Xerox Corporation, Stamford, Conn.

[21] Appl. No.: 428,372

[22] Filed: Oct. 27, 1989

Related U.S. Application Data

[63] Continuation of Ser. No. 81,261, Aug. 3, 1987, abandoned.

[51] Int. Cl.[5] ..... G03G 9/083; G03G 9/087; G03G 9/113

[52] U.S. Cl. ..... 430/106.6; 430/108; 430/109; 430/110; 430/126; 430/137

[58] Field of Search ..... 430/106.6, 108, 109, 430/110, 126, 137

[56] References Cited

U.S. PATENT DOCUMENTS 4,558,108 12/1985 Alexandra et al. ..... 526/340

FOREIGN PATENT DOCUMENTS 62-106475 5/1987 Japan .

*Primary Examiner*—Roland E. Martin

*Attorney, Agent, or Firm*—Judith L. Byorick; Eugene O. Palazzo

[57] ABSTRACT

Developer compositions with toner compositions comprised of suspension polymerized styrene butadiene polymers, pigment particles, magnetites, and charge enhancing additives; and carrier components comprised of a carrier core with a coating thereover comprised of a polymer mixture with from about 10 to about 90 percent by weight of a first polymer, and from about 90 to about 10 percent by weight of a second polymer, which first and second polymers are not in close proximity in the triboelectric series.

35 Claims, No Drawings

DEVELOPER COMPOSITIONS WITH SUSPENSION POLYMERIZED STYRENE BUTADIENE RESINS

This is a continuation, of application Ser. No. 081,261, filed Aug. 3, 1987, now abandoned.

BACKGROUND OF THE INVENTION

This invention is generally directed to developer compositions, and more specifically, the present invention relates to developer compositions wherein the toner resin particles are comprised of specific styrene butadienes. More specifically, in one embodiment of the present invention there are provided developer compositions formulated by admixing toner compositions and carrier components, and wherein the toner compositions contain therein as resin particles suspension polymerized styrene butadiene as illustrated in U.S. Pat. No. 4,558,108, the disclosure of which is totally incorporated herein by reference. Of further importance with respect to the invention of the present application is the selection of carrier particles prepared by a dry coating process wherein a mixture of certain polymers is applied to the carrier enabling insulating particles with relatively constant conductivity parameters; and also wherein the triboelectric charge on the carrier can vary significantly depending on the coatings selected. The aforementioned carrier particles are illustrated in U.S. Ser. No. 793,042, the disclosure of which is totally incorporated herein by reference. Developer compositions of the present invention possess at low (about 20 percent) and high (about 80 percent) relative humidities stable triboelectric charging values for extended time periods exceeding, for example, two million imaging cycles; rapid admix characteristics; excellent blocking and fusing properties; and excellent aging characteristics. The toner and developer compositions of the present invention are particularly useful in electrophotographic printing and imaging systems, especially xerographic imaging process. Furthermore, in the aforementioned imaging processes the triboelectric charge on the carrier particles can be preselected independent of the conductivity depending, for example, on the polymer composition applied to the carrier cores.

The electrophotographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions are appropriate triboelectric changing values associated therewith, as it is these values that enable continued constant developed images of high quality and excellent resolution; and admixing characteristics. Thus, toner and developer compositions are known, wherein there are selected as the toner resin styrene acrylates, styrene methacrylates, and certain styrene butadienes including those available as Pliolites. Other resins have also been selected for incorporation into toner compositions inclusive of the polyesters as illustrated in U.S. Pat. No. 3,590,000. Moreover, it is known that single component magnetic toners can be formulated with styrene butadiene resins, particularly those resins available as Pliolite. In addition, positively charged toner compositions containing various resins, inclusive of certain styrene butadienes and charge enhancing additives, are known. For example, there are described in U.S. Pat. No. 4,560,635, the disclosure of which is totally incorporated herein by reference, positively charged toner compositions with distearyl dimethyl ammonium methylsulfate charge enhancing additives. This patent also illustrates the utilization of suspension polymerized styrene butadiene for incorporation into toner compositions, reference working Example IX.

In addition, a number of different carrier particles have been illustrated in the prior art, reference for example the U.S. Pat. No. 3,590,000 mentioned herein; and U.S. Pat. No. 4,233,387, wherein coated carrier components for developer mixtures which are comprised of finely divided toner particles clinging to the surface of the carrier particles are recited. Specifically, there are disclosed in the '387 patent coated carrier particles obtained by mixing carrier core particles of an average diameter of from about 30 microns to about 1,000 microns with from about 0.05 percent to about 3.0 percent by weight, based on the weight of the coated carrier particles, of thermoplastic resin particles. More specifically, there are illustrated in the '387 patent processes for the preparation of carrier particles by a powder coating process; and wherein the carrier particles consist of a core with a coating thereover comprised of polymers. More specifically, the carrier particles selected can be prepared by mixing low density porous magnetic, or magnetically attractable metal core carrier particles with from, for example, between about 0.05 percent and about 3 percent by weight, based on the weight of the coated carrier particle of polymers until adherence thereof to the carrier core by mechanical impaction or electrostatic attraction; heating the mixture of carrier core particles and polymers to a temperature of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size. Also, in a specific embodiment of the aforementioned copending application U.S. Ser. No. 793,042, there are disclosed carrier particles comprised of a core with a coating thereover comprised of a mixture of a first dry polymer component and a second dry polymer component not in close proximity to the first polymer in the triboelectric series. Therefore, the aforementioned carrier compositions can be comprised of known core materials including iron with a dry polymer coating mixture thereover. Subsequently, developer compositions can be generated by admixing the aforementioned carrier particles with a toner composition comprised of resin particles and pigment particles.

Other patents of interest include U.S. Pat. No. 3,939,086, which teaches steel carrier beads with polyethylene coatings, see column 6; U.S. Pat. Nos. 3,533,835; 3,658,500; 3,798,167; 3,918,968; 3,922,382; 4,238,558; 4,310,611; 4,397,935; and 4,434,220. Moreover, there are illustrated in U.S. Pat. No. 4,469,770, toner and developer compositions wherein there is incorporated into the toner styrene butadiene resins prepared by emulsion polymerization processes.

Additionally, in copending U.S. applicaton Ser. No. 751,922, the disclosure of which is totally incorporated herein by reference, entitled Developer Compositions With Specific Carrier Particles, developers containing toners with styrene butadiene copolymers, pigment particles inclusive of magnetites, charge control additives, and carrier particles containing a core with a coating thereover of vinyl copolymers, or homopolymers, such as vinyl chloride/vinyl acetate are illustrated. The aforementioned carrier particles can be prepared by solution coating processes.

With further respect to carrier particles, recent efforts have focused on the attainment of coatings for these particles for the purpose of improving development quality; and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits. With the developer compositions of the present invention, these disadvantages are alleviated.

Furthermore, with reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses. The powder coating process selected for the carrier components of the present invention overcomes these disadvantages, and further enables developer mixtures that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the carrier particles of the present invention, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with breakdown voltages of from about 1,000 to in excess of about 2,000 as determined in a magnetic brush conducting cell. In this device, the carrier composition or developer composition can be placed on a 1.5 inch diameter magnetic roll, followed by applying a voltage across the composition, and measuring with a probe the amount of current which passes through the carrier composition or the developer composition to a measurement electrode for a specific applied voltage V. The measurement electrode surrounded by a grounded guard plate has a surface area of 3.0 $cm^2$, and the developer roll to electrode spacing is usually about 2.54 millimeters. The breakdown potential is that potential at which these components begin to conduct large electrical currents, that is currents approaching 0.1 milliamps. Also, the developer compositions of the present invention possess triboelectric charging values of from about 10 to 35 microcoulombs per gram on the carrier particles as determined by the known Faraday Cage technique. Thus, the developers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved, and the conductivities are altered by retaining the polymer ratio coating constant and modifying the coating weight for the carrier particles. Also, with the present invention there is provided toner and developer compositions with other improved characteristics, including superior aging properties. Thus, there is a need for developer compositions with stable charging characteristics. There is also a need for positively charged toner compositions with many of the advantages indicated herein, and wherein there is selected specific styrene butadiene resins. In addition, there is a need for positively charged toner compositions, especially those with magnetites therein which possess excellent blocking properties, acceptable fusing temperature latitudes, and superior charging properties. There is also a need for toner and developer compositions possessing excellent admix charging times of, for example, less than 15 seconds; and wherein the aforementioned compositions are insensitive to relative humidities of from about 20 to about 80 percent. Furthermore, there is a need for toner and developer compositions that will enable the generation of excellent solid areas, substantially no background deposits, and full gray scale reproduction of half tone images.

SUMMARY OF THE INVENTION

It is an object of the present invention to provide developer compositions which possess many of the above noted advantages.

In another object of the present invention there are provided developer compositions with positively charged toners containing therein suspension polymerized styrene butadiene resins.

Also, in another object of the present invention there are provided developer compositions comprised of toners with suspension polymerized styrene butadiene resins, and certain carrier particles.

Further, in an additional object of the present invention there are provided positively charged toner compositions containing therein suspension polymerized styrene butadiene resins, and charge enhancing additives.

Additionally, in another object of the present invention there are provided improved developers with positively charged toner compositions that possess excellent electrical properties.

Moreover, in another object of the present invention there are provided developers with stable triboelectric charging characteristics for extended time periods.

Another object of the present invention resides in the provision of toner compositions with excellent blocking temperatures, and acceptable fusing temperature latitudes.

Furthermore, in an additional object of the present invention there are provided developer compositions containing carrier particles with a coating thereover consisting of a mixture of polymers that are not in close proximity in the triboelectric series.

Also, in yet still another object of the present invention there are provided methods for the development of electrostatic latent images with toner compositions containing therein suspension polymerized styrene butadiene resins, and charge enhancing additives.

In yet another object of the present invention there are provided developer compositions with carrier components obtained by a dry coating process, which particles possess substantially constant conductivity parameters, and a wide range of preselected triboelectric charging values.

Furthermore, in yet a further object of the present invention there are provided developer compositions with carrier particles comprised of a coating with a mixture of polymers that are not in close proximity, that is for example a mixture of polymers from different positions in the triboelectric series, and wherein the toner compositions incorporated therein possess excellent admix charging values of, for example, less than 15 seconds.

Another object of the present invention resides in the provision of toner and developer compositions, which are insensitive to relative humidities of from about 20 to about 80 percent, and which compositions possess superior aging characteristics enabling their utilization for a substantial number of imaging cycles with substantially no modification of the triboelectrical properties, and other characteristics.

Additionally, in still a further object of the present invention there are provided developer compositions with carrier particles possessing insulating characteristics, and comprised of a core with a coating thereover generated from a mixture of polymers.

These and other objects of the present invention are accomplished by providing developer compositions containing therein suspension polymerized styrene butadiene resins. More specifically, in one embodiment of the present invention there are provided developer compositions comprised of positively charged toner compositions with suspension polymerized styrene butadiene resins, and carrier particles prepared by a powder coating process; and wherein the carrier particles are comprised of a core with a coating thereover comprised of a mixture of polymers that are not in close proximity in the triboelectric series. Thus, in one embodiment of the present invention there are provided developer compositions comprised of a toner composition comprised of suspension polymerized styrene butadiene polymers, pigment particles, and charge enhancing additives; and carrier components comprised of a carrier core with a coating thereover comprised of a polymer mixture with from about 10 to about 90 percent by weight of a first polymer, and from about 90 to about 10 percent by weight of a second polymer, which first and second polymers are not in close proximity in the triboelectric series.

With further reference to the present invention, the toner compositions selected are comprised of suspension polymerized styrene butadiene resins, pigment particles, inclusive of carbon black, magnetites, and charge enhancing additives. The aforementioned suspension polymerized styrene butadiene resins are illustrated in U.S. Pat. No. 4,558,108, the disclosure of which has been totally incorporated herein by reference. More specifically, these resin particles are prepared by a process which comprises forming a copolymer of styrene and butadiene comprising providing an aqueous phase comprising an aqueous mixture comprising water, styrene monomer, butadiene monomer, a suspension stabilizing agent, and a chain propagating amount of a free radical polymerization initiator insoluble in water, soluble in said styrene monomer, soluble in said butadiene monomer, and having a 1 hour half-life between about 50° C. and about 130° C. with the ratio of said styrene monomer and said butadiene monomer being between about 80:20 and about 95:5 by weight; the weight proportion of water to the combination of said styrene monomer and said butadiene monomer being between about 8:1 and about 2:1, said suspension stabilizing agent consisting essentially of a finely-divided, difficultly water-soluble powder and a vapor phase comprising an inert gas and butadiene monomer; heating said aqueous phase and said vapor phase to a temperature between about 50° C. and about 130° C. at a pressure between about 20 psi and about 140 psi in the absence of redox initiators and mercaptan compounds; removing butadiene monomer from said vapor phase after at least about 75 percent by weight of said butadiene monomer and said styrene monomer in said aqueous phase are converted to a copolymer, and prior to conversion of more than about 98 percent by weight of said butadiene monomer and said styrene monomer to a copolymer in said aqueous phase; and heating said aqueous phase at a temperature between about 50° C. and about 130° C. at a pressure between about 20 psi and about 140 psi until at least about 90 percent by weight of said styrene monomer and said butadiene monomer are copolymerized to form an aqueous suspension of discrete copolymer particles having a Tg (glass transition) value of between about 45° C. and about 65° C., a weight average molecular weight of between about 10,000 and about 400,000, a molecular weight distribution of said copolymer between about 2 and about 9, and a butadiene monomer concentration of less than about 10 parts per million by weight.

The resin particles are present in a sufficient, but effective amount, thus when 10 percent by weight of pigment or colorant such as carbon black is contained therein about 90 percent by weight of resin material is selected. Generally, however, providing the objectives of the present invention are achieved, the toner composition is comprised of from about 75 percent to about 95 percent by weight of toner resin particles, from about 2 percent by weight to about 20 percent by weight of pigment particles such as carbon black, and from about 0.1 to about 10 percent by weight of charge enhancing additive providing the total amount of components equals about 100 percent.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20 percent by weight based on the total weight of the toner composition, however, lesser or greater amounts of pigment particles can be selected providing the objectives of the present invention are achieved.

Various magnetites, which are comprised of a mixture of iron oxides ($FeO.Fe_2O_3$), in most situations including those commercially available such as Mapico Black, can be selected for incorporation into the toner compositions illustrated herein. The aforementioned magnetite particles are present in various effective amounts, generally however, they are present in the toner composition in an amount of from about 10 percent by weight to about 25 percent by weight, and preferably in an amount of from about 16 percent by weight to about 19 percent by weight. Other magnetites not specifically disclosed herein may be selected provided the objectives of the present invention are achievable.

A number of different charge enhancing additives may be selected for incorporation into the toner compositions of the present invention to enable these compositions to acquire a positive charge thereon of from, for example, about 10 to about 35 microcoulombs per gram. Examples of charge enhancing additives include alkyl pyridinium halides, especially cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and other similar known charge enhancing additives. These additives are usually incorporated into the toner in an amount of from about 0.1 percent by weight to about 20 percent by weight, and preferably these additives are present in an amount of from about 0.2 percent by weight to about 5 percent by weight.

The toner compositions of the present invention can be prepared by a number of known methods including melt blending the toner resin particles, the pigment particles or colorants, and charge enhancing additives; followed by mechanical attrition. Other methods include those well known in the art such as spray drying, melt dispersion, dispersion polymerization, extrusion processing, and suspension polymerization. In one dispersion polymerization method, a solvent dispersion of the resin particles and the pigment particles are spray dried under controlled conditions to result in the desired product.

Important characteristics associated with the toner compositions of the present invention include a blocking temperature of greater than 125° F., and a fusing temperature latitude of from about 300° to about 450° F. Moreover, the aforementioned toners possess stable triboelectric charging values of from about 10 to about 30 microcoulombs per gram for an extended number of imaging cycles exceeding, for example, in some embodiments two million developed copies. Although it is not desired to be limited by theory, it is believed that an important factor for the slow, or substantially no degradation in the triboelectric charging values resides in the unique rheological properties of the suspension polymerized butadiene resins selected.

As carrier particles for enabling the formulation of developer compositions when admixed with the toner described herein there is selected those particles prepared by a powder coating process as illustrated in copending application U.S. Ser. No. 793,042, the disclosure of which is totally incorporated herein by reference. More specifically, the carrier particles selected can be prepared by mixing low density porous magnetic, or magnetically attractable metal core carrier particles with from, for example, between about 0.05 percent and about 3 percent by weight based on the weight of the coated carrier particles of a mixture of polymers not in close proximity in the triboelectric series until adherence thereof to the carrier core by mechanical impaction or electrostatic attraction; heating the mixture of carrier core particles and polymers to a temperature, for example, of between from about 200° F. to about 550° F., for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention, there are provided carrier particles, especially particles with a breakdown voltage of greater than 1,000 volts, comprised of a core with a coating thereover comprised of a mixture of a first dry polymer component and a second dry polymer component. Therefore, the aforementioned carrier compositions can be comprised of known core materials including iron with a dry polymer coating mixture thereover. More specifically, the carrier particles selected for the developer compositions of the present invention, which carrier particles possess substantially stable conductivity parameters, are prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particle and polymer mixture to a temperature of between 200° F. and about 550° F., whereby the polymer mixture melts and fuses to the carrier core particles; and (4) thereafter cooling the resulting coated carrier particles. Subsequently, developer compositions of the present invention can be generated by admixing the aforementioned carrier particles with a toner composition comprised of resin particle and pigment particles.

Various suitable solid core carrier materials can be selected providing the objectives of the present invention are obtained. Characteristic carrier properties of importance include those that will enable the toner particles to acquire a positive charge, and carrier cores that will permit desirable flow properties in the developer reservoir present in the xerographic imaging apparatus. Also of importance with regard to the carrier core properties are, for example, suitable magnetic characteristics that will permit magnetic brush formation in magnetic brush development processes; and wherein the carrier cores possess desirable mechanical aging characteristics. Examples of carrier cores that can be selected include iron, steel, ferrites, magnetites, nickel, and mixtures thereof. Preferred carrier cores include ferrites and sponge iron, or steel grit with an average particle size diameter of from between about 30 microns to about 200 microns.

Illustrative examples of polymer coatings selected for the carrier particles of the present invention include those that are not in close proximity in the triboelectric series, reference U.S. Ser. No. 793,042, the disclosure of which is totally incorporated herein by reference. Specific examples of polymer mixtures used are polyvinylidenefluoride with polyethylene, polymethylmethacrylate and copolyethylenevinylacetate; copolyvinylidenefluoride, tetrafluoroethylene and polyethylene; polymethylmethacrylate and copolyethylene vinylacetate; and polymethylmethacrylate and polyvinylidenefluoride. Other related polymer mixtures not specifically mentioned herein can be selected providing the objectives of the present invention are achieved.

With further reference to the polymer coating mixture, by close proximity as used herein it is meant that the choice of the polymers selected are dictated by their position in the triboelectric series, therefore for example, one may select a first polymer with a significantly lower triboelectric charging value than the second polymer.

The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer. In one embodiment of the present invention, when a high triboelectric charging value is desired, that is exceeding 30 microcoulombs per gram, there is selected from about 50 percent by weight of the first polymer such as a polyvinylidene fluoride, commercially available as Kynar 301F; and 50 percent by weight of a second polymer such as polymethylacrylate. In contrast, when a lower triboelectric charging value is required, less than for example about 10 microcoulombs per gram, there is selected from about 30 percent by weight of the first polymer; and 70 percent by weight of the second polymer.

Generally, from about 1 part to about 5 parts by weight of toner particles are mixed with from about 10 to about 300 parts by weight of the carrier particles illustrated herein enabling the formation of developer compositions.

Also encompassed within the scope of the present invention are colored toner compositions comprised of toner resin particles, carrier particles, and as pigments or colorants present in the toner, magenta, cyan, or yellow particles as well as mixtures thereof. More specifically, illustrative examples of magenta materials that may be selected as pigments include 1,9-dimethyl-substituted quinacridone and anthraquinone dye identified in the Color Index as CI 60720; CI Dispersed Red 15, a diazo dye identified in the Color Index as CI 26050; CI Solvent Red 19; and the like. Examples of cyan materials that may be used as pigments include copper tetra-4(octadecyl sulfonamido) phthalocyanine; X-copper phthalocyanine pigment listed in the Color Index as CI 74160; CI Pigment Blue; and Anthrathrene Blue, identified in the Color Index as CI 69810; Special Blue X-2137; and the like; while illustrative examples of yellow pigments that may be selected are diarylide yellow 3,3-dichlorobenzidene acetoacetanilides, a monoazo pigment identified in the Color Index as CI 12700; CI Solvent Yellow 16, a nitrophenyl amine sulfonamide identified in the Color Index as Foron Yellow SE/GLN; CI Dispersed Yellow 33, 2,5-dimethoxy-4-sulfonanilide phenylazo-4'-chloro-2,5-dimethoxy acetoacetanilide; Permanent Yellow FGL; and the like. These pigments are generally present in the toner composition in an amount of from about 1 weight percent to about 15 weight percent based on the weight of the toner resin particles.

In addition, the toner and developer compositions of the present invention may be selected for use in electrophotographic imaging processes containing therein conventional photoreceptors, including inorganic and organic photoreceptor imaging members. Examples of imaging members are selenium, selenium alloys; and selenium or selenium alloys containing therein additives or dopants such as halogens. These imaging members are conventionally charged positively. In a printer application, the image area can be discharged by light, and a high positive electrical DC bias applied to the development roll. This will permit the development of the positively charged toner onto the inorganic photoreceptor imaging member. Furthermore, there is preferably selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. Also, there can be selected as photogenerating pigments, squaraine compounds, thiapyrillium materials, and the like. As charge transport molecules there can be selected the aryl amines disclosed in the '990 patent. These layered members are conventionally charged negatively thus requiring a positively charged toner. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. Images obtained with the developer compositions of the present invention possess dark, uniform solids having optical densities greater than 1.20, excellent halftones, and sharp line resolution with acceptable or substantially no background deposits.

With further respect to the developer compositions of the present invention, in another important embodiment the carrier coatings include therein conductive particles such as carbon black in various effective amounts as illustrated in the aforementioned copending application.

The following examples are being supplied to further define the present invention, it being noted that these examples are intended to illustrate and not limit the scope of the present invention. Parts and percentages are by weight unless otherwise indicated.

With regard to the Examples that follow, the aging fixture selected consists of a developer housing with a single development roll moving in the opposite direction as the photoreceptor drum comprised of an arsenic selenium alloy, 99 percent selenium, 1 percent arsenic, deposited on an aluminum substrate. This photoreceptor was maintained in a discharged state in that it is discharged to substantially zero volts by a fluorescent lamp and a corotron. In this device, the housing was sequentially electrically biased with 95 volts DC, and 580 volts DC to result in background development for 95 percent of the drum cycle and solid area image development for 5 percent of the cycle. Also, the density of the background and image patches on the photoreceptor was monitored continuously by an infrared sensor. The output of the sensor controls the toner dispensing systems in that this sensor determines the amount of toner that was added to the developer housing, and hence to the electrostatic image. Further, the imaged toner was removed after each cycle by a brush cleaner, proceeded by dicorotron charging, in order to provide a clean selenium alloy photoreceptor for each development step. Using this aging device, key developer composition properties were measured at different times, for example, $t_1$ and $t_2$, including toner concentration and triboelectric charging values. Graphs of the triboelectric parameter, $A_t=(TC+1)$ tribo were then plotted as a function of aging time with one hour of aging in the aging fixture being equal to approximately 4,000 copies, which graphs can be used to assess developer performance. Also, unless otherwise noted, the triboelectric charge values reported were accomplished at 50 percent relative humidity, and at room temperature.

EXAMPLE I

There was prepared by extrusion processing a magnetic toner composition containing 1 percent by weight of the charge enhancing additive distearyl dimethyl ammonium methyl sulfate, 4 percent by weight of carbon black, 16 percent by weight of Mapico Black magnetite particles, and 79 percent by weight of styrene butadiene resin particles, with 10 parts of styrene, and 1 part of butadiene, which resin was formulated by an emulsion polymerized process as illustrated in U.S. Pat. No. 4,469,770, the disclosure of which is totally incorporated herein by reference. The extrusion process which is well known involves melt mixing the above components in a ZSK-53 extruder purchased from Werner and Pfleiderer Corporation, Ramsey, N.J.

A developer composition was then prepared by mixing 200 grams of carrier particles, and 6 grams of the above prepared toner composition, wherein the carrier particles were comprised of a Toniolo atomized steel core, 120 microns in diameter, containing as a coating thereon 1.25 percent of a copolymer of vinylchloride/-chlorotrifluoroethylene with the coating having dispersed therein 7.5 percent of carbon black particles. Mixing was accomplished by placing the toner, and carrier particles in an 8 ounce glass jar with a tightened screw cap thereon on a paint shaker for 10 minutes. Subsequent to removal of a sample of developer composition, a standard blow off tribo measurement was affected in a Faraday Cage, and there was measured on the toner a positive charge of 32 microcoulombs per gram. The above prepared developer composition was then incorporated into the aging fixture indicated here, which fixture mimics the xerographic process. The charging ability of the developer at a given time is represented by $A_t=(TC+1)$ tribo, wherein TC is the toner concentration, and tribo is the triboelectric charge on the toner. Triboelectric aging for the above prepared developer evidences a rapid initial decline followed by a more gradual exponential degradation.

The exponential degradation is expressed as $A_{t2}=A_{t1}\exp[-k(t_2-t_1)]$, wherein $t_1$ was 47 hours, $t_2$ was 98 hours, $A_{t1}$ was 46.3 microcoulombs per gram, $A_{t2}$ was 28 microcoulombs per gram, and k is the degradation rate. For the above prepared developer the degradation rate was 0.0098 hours$^{-1}$. Also, the life of this developer, which is inversely proportional to the degradation rate constant k, would be 70 hours (about 280,000 copies).

EXAMPLE II

A magnetic toner and developer composition was prepared by repeating the procedure of Example I with the exception that there was selected in place of the emulsion polymerized styrene butadiene, a suspension polymerized styrene butadiene prepared by the process as illustrated in U.S. Pat. No. 4,558,108. The toner resulting possessed a triboelectric charge of a positive 30 microcoulombs per gram. Also, the triboelectric aging curve was similar to that of the developer of Example I with the exception that the long term degradation rate k was 0.0063 hour$^{-1}$, $t_1$ was 17 hours, $t_2$ was 72 hours, $A_{t1}$ was 107 microcoulombs per gram, and $A_{t2}$ was 73 microcoulombs per gram. For this developer, the life would thus be 110 hours (about 440,000 copies).

EXAMPLE III

A magnetic toner and developer composition of the present invention was prepared by repeating the procedure of Example II with the exception that there was selected as carrier particles a steel core with a coating thereover of 0.7 percent by weight of a dry mixture of 40 percent by weight of polyvinylidene fluoride available as Kynar 301F, and 60 percent by weight of polymethyl methacrylate, which particles were prepared as illustrated in U.S. Ser. No. 793,042, the disclosure of which is totally incorporated herein by reference. The aforementioned components were admixed for 60 minutes in a Munson MX-1 blender rotating at 27.5 RPM. Thereafter, the carrier particles resulting were metered at a rate of 110 grams per minute into a rotating tube furnace, which was maintained at a temperature of 410° F. A developer composition was then prepared by mixing 200 grams of the prepared carrier particles, and 6 grams of the toner composition of Example II in an 8 ounce glass jar with a tightened screw cap thereon on a paint shaker for 10 minutes. Subsequent to the removal of a sample of developer composition, a standard blow off tribo measurement was affected and there resulted on the toner a positive triboelectric charge of 15 microcoulombs per gram. The triboelectric aging of this developer composition in the aging test fixture indicated that it was superior to the triboelectric aging of the developers of Examples I and II in that there was an initial rise in $A_t$, followed by a very slow exponential degradation ($k=0.0025$ hour$^{-1}$) in the triboelectric aging curve. For the prepared developer of this Example, the life was 280 hours (about 1,100,000 copies), $t_1$ was 67 hours, $t_2$ was 142 hours, $A_{t1}$ was 211 microcoulombs per gram, and $A_{t2}$ was 175 microcoulombs per gram.

EXAMPLE IV

A magnetic toner composition was prepared by repeating the procedure of Example I with the exception that there was selected 76.5 percent of the resin, 4 percent of carbon black, 19 percent of magnetite, and 0.5 percent of distearyl dimethyl ammonium methyl sulfate. Subsequently, this toner was mixed with the carrier particles of Example III with the exception that the coating mixture contained 35 percent by weight of Kynar 301F, and 65 percent by weight of polymethyl methacrylate. Subsequent to mixing in a paint shaker for 10 minutes, the toner had a triboelectric charge thereon of 9.5 microcoulombs per gram. In the aging fixture, this developer composition had a tribo degradation rate of 0.0021 hour$^{-1}$, $t_1$ was 89 hours, $t_2$ was 204 hours, $A_{t1}$ was 81 microcoulombs per gram, and $A_{t2}$ was 64 microcoulombs per gram. Also, it is believed that this developer would have a life of 330 hours, or 1,300,000 copies.

However, when the above prepared developer was exposed to a relative humidity of 80 percent for 24 hours in a glove box at 80° F., it exhibited a 57 percent loss in tribocharging ability, thus the triboelectric charge on the toner decreased from 9.5 to 4.1 microcoulombs per gram. The aforementioned decreases reduce the developer life to 34 hours, or 135,000 copies at 80 percent relative humidity.

EXAMPLE V

A developer composition was prepared by repeating the procedure of Example IV with the exception that there was selected the suspension polymerized styrene butadiene of Example II, and there resulted a toner with a triboelectric charge thereon of 17 microcoulombs per gram, and a tribo degradation rate of only 0.0013 hour$^{-1}$; and wherein $t_1$ was 79 hours, $t_2$ was 237 hours, $A_{t1}$ was 108 microcoulombs per gram, and $A_{t2}$ was 88 microcoulombs per gram. The life of this developer was projected to be 500 hours, or 2,000,000 copies. Additionally, the toner of this Example was placed in a glove box, and exposed to a relative humidity of 80 percent at about 80° F. for 24 hours, and there resulted only a 20 percent loss for the triboelectric charge on the toner, thus reducing the developer life to 335 hours, or 1,340,000 copies from 2,000,000 copies as compared to a 57 percent charge loss for the toner of Example IV. Additionally, the admixing time was 15 seconds subsequent to the addition of one percent of the above prepared toner composition to the developer composition of this Example.

EXAMPLE VI

A developer composition was prepared by repeating the procedure of Example V with the exception that there was selected 15.5 percent by weight of magnetite, and 79.5 percent by weight of the suspension polymerized styrene butadiene resin. This developer was then incorporated into a high speed, greater than 70 copies per minute, xerographic imaging test fixture wherein the imaging member selected was comprised of a supporting substrate of Mylar overcoated with a photogenerating layer of trigonal selenium, 95 percent by weight, dispersed in a polycarbazole resinous binder, and as a top layer in contact with the photogenerating layer a charge transport layer of N,N'-bis(3-methylphenyl)1,1'-biphenyl-4,4' diamine molecules, 55 percent by weight, dispersed in 45 percent by weight of a polycarbonate resinous binder commercially available as Makrolon, reference U.S. Pat. No. 4,265,990, the disclosure of which is totally incorporated herein by reference.

There resulted for 2,000,000 developed copies, smudgeproof images with no background deposits. The triboelectric aging of this material was very stable with values of the triboelectric parameter $A_t$ ranging from 80 to 116. The breakdown voltage of the carrier remained in an acceptable value specifically unmeasurable, but greater than 1,500 volts, and ending (2,000,000 copies) at 400 volts. No change in copy quality (no background deposits, no loss of line sharpness, and full gray scale reproduction for halftones) resulted for 2,000,000 copies.

EXAMPLE VII

The toner composition of Example III was prepared into a developer composition by admixing carrier particles therewith comprised of an oxidized steel core, available from Toniolo Inc., with a semicontinuous dry fused coating (carrier core and coating mixed for 70 minutes prior to fusing, reference U.S. Pat. No. 4,233,387, the disclosure of which is totally incorporated herein by reference) thereover of 0.15 percent by weight of polyvinylidene fluoride. The breakdown voltage of this carrier was less than 100 volts, which results in a significant loss of the full gray scale reproduction for halftones, and the triboelectric charge of the resulting developer mixture was 45 microcoulombs per gram.

Other modifications of the present invention may occur to those skilled in the art subsequent to a review of the present application, and these modifications as well as equivalents thereof are intended to be included within the scope of the present invention.

What is claimed is:

1. Developer compositions with toner compositions comprised of suspension polymerized styrene butadiene polymers, pigment particles, and charge enhancing additives; and carrier components comprised of a carrier core with a coating thereover comprised of a polymer mixture with from about 10 to about 90 percent by weight of a first polymer, and from about 90 to about 10 percent by weight of a second polymer, which first and second polymers are not in close proximity in the triboelectric series.

2. A developer composition in accordance with claim 1 wherein the suspension polymerized styrene butadiene polymer is comprised of from about 80 to about 90 percent by weight of styrene, and from about 20 to about 10 percent by weight of butadiene.

3. A developer composition in accordance with claim 1 wherein the suspension polymerized styrene butadiene is prepared by a process which comprises a process for forming a copolymer of styrene and butadiene comprising providing an aqueous phase comprising an aqueous mixture comprising a water, styrene monomer, a butadiene monomer, a suspension stabilizing agent, and a chain propagating amount of a free radical polymerization initiator insoluble in water, soluble in said styrene monomer, soluble in said butadiene monomer, and having a 1 hour half-life between about 50° C. and about 130° C., the ratio of said styrene monomer and said butadiene monomer being between about 80:20 and about 95:5 by weight with the weight proportion of water to the combination of said styrene monomer and said butadiene monomer being between about 8:1 and about 2:1, said suspension stabilizing agent consisting essentially of a finely-divided, difficultly water-soluble powder, and a vapor phase comprising an inert gas and butadiene monomer; heating said aqueous phase and said vapor phase to a temperature between about 50° C. and about 130° C. at a pressure between about 20 psi and about 140 psi in the absence of redox initiators and mercaptan compounds; removing butadiene monomer from said vapor phase after at least about 75 percent by weight of said butadiene monomer and said styrene monomer in said aqueous phase are converted to a copolymer, and prior to conversion of more than about 98 percent by weight of said butadiene monomer and said styrene monomer to a copolymer in said aqueous phase; and heating said aqueous phase at a temperature between about 50° C. and about 130° C. at a pressure between about 20 psi and about 140 psi until at least about 90 percent by weight of said styrene monomer and said butadiene monomer are copolymerized to form an aqueous suspension of discrete copolymer particles having a Tg value of between about 45° C. and about 65° C., a weight average molecular weight of between about 10,000 and about 400,000, a molecular weight distribution of said copolymer between about 2 and about 9, and a butadiene monomer concentration of less than about 10 parts per million by weight.

4. A developer composition in accordance with claim 1 wherein the pigment particles are carbon black, magnetites, or mixtures thereof.

5. A developer composition in accordance with claim 1 wherein the charge enhancing additives are selected from the group consisting of alkyl pyridinium halides, organic sulfates, and sulfonates; and distearyl dimethyl ammonium methylsulfate.

6. A developer composition in accordance with claim 1 wherein the charge enhancing additive is distearyl dimethyl ammonium methylsulfate.

7. A developer composition in accordance with claim 1 wherein the polymer mixture selected is comprised of from about 30 percent by weight to about 60 percent by weight of the first polymer, and from about 70 percent by weight to about 40 percent by weight of the second polymer.

8. A developer composition in accordance with claim 1 wherein the first polymer is polyvinylidene fluoride, and the second polymer is polymethyl methacrylate.

9. A developer composition in accordance with claim 1 wherein the triboelectric charge on the toner particles is from about 10 to about 35 microcoulombs per gram.

10. A developer composition in accordance with claim 1 wherein the breakdown voltage of the carrier particles is greater than 1,000 volts.

11. A developer composition in accordance with claim 1 wherein the carrier particles are prepared by a process which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles.

12. A developer composition in accordance with claim 1 wherein the suspension polymerized styrene butadiene is present in an amount of from about 70 to about 85 percent by weight.

13. A developer composition in accordance with claim 1 wherein the charge enhancing additive is present in an amount of from about 0.1 to about 10 percent by weight.

14. A developer composition in accordance with claim 1 wherein the pigment particles, exclusive of magnetites, are present in an amount of from about 0.1 to about 5 percent by weight.

15. A developer composition in accordance with claim 1 wherein the magnetite is present in an amount of from about 10 to about 25 percent by weight.

16. A developer composition in accordance with claim 14 wherein the pigment particles are carbon black.

17. A developer composition in accordance with claim 3 with a positive triboelectric charge thereon of from about 10 to about 30 microcoulombs per gram.

18. A developer composition in accordance with claim 1 with stable triboelectric charging characteristics for extended time periods.

19. A developer composition in accordance with claim 1 wherein the carrier core is selected from the group consisting of steel, iron, nickel and ferrites.

20. A method for developing images which comprises the formation of an electrostatic latent image on a photoconductive member; developing the resulting image with the composition of claim 1; subsequently transferring the developed image to a suitable substrate; and thereafter permanently affixing the image thereto.

21. A method of imaging in accordance with claim 20 wherein the developer composition maintains its electrical characteristics for about two million copies.

22. A method of imaging in accordance with claim 21 wherein stability of the developer is present at a relative humidity of from about 20 to about 80 percent.

23. A method of imaging in accordance with claim 20 wherein the suspension polymerized styrene butadiene polymer is comprised of from about 80 to about 90 percent by weight of styrene, and from about 20 to about 10 percent by weight of butadiene.

24. A method of imaging in accordance with claim 20 wherein the suspension polymerized styrene butadiene is prepared by a process which comprises a process which comprises a process for forming a copolymer of styrene and butadiene comprising providing an aqueous phase comprising an aqueous mixture comprising a water, styrene monomer, a butadiene monomer, a suspension stabilizing agent, and a chain propagating amount of a free radical polymerization initiator insoluble in water, soluble in said styrene monomer, soluble in said butadiene monomer, and having a 1 hour half-life between about 50° C. and about 130° C., the ratio of said styrene monomer and said butadiene monomer being between about 80:20 and about 95:5 by weight with the weight proportion of water to the combination of said styrene monomer and said butadiene monomer being between about 8:1 and about 2:1, said suspension stabilizing agent consisting essentially of a finely-divided, difficulty water-soluble powder, and a vapor phase comprising an inert gas and butadiene monomer; heating said aqueous phase and said vapor phase to a temperature between about 50° C. and about 130° C. at a pressure between about 20 psi and about 140 psi in the absence of redox initiators and mercaptan compounds, removing butadiene monomer from said vapor phase after at least about 75 percent by weight of said butadiene monomer and said styrene monomer in said aqueous phase are converted to a copolymer, and prior to conversion of more than about 98 percent by weight of said butadiene monomer and said styrene monomer to a copolymer in said aqueous phase; and heating said aqueous phase at a temperature between about 50° C. and about 130° C. at a pressure between about 20 psi and about 140 psi until at least about 90 percent by weight of said styrene monomer and said butadiene monomer are copolymerized to form an aqueous suspension of discrete copolymer particles having a Tg value of between about 45° C. and about 65° C., a weight average molecular weight of between about 10,000 and about 400,000, a molecular weight distribution of said copolymer between about 2 and about 9, and a butadiene monomer concentration of less than about 10 parts per million by weight.

25. A method of imaging in accordance with claim 20 wherein the developer composition contains as the pigment particles carbon black, magnetites, or mixtures thereof.

26. A method of imaging in accordance with claim 20 wherein the charge enhancing additives for the toner are selected from the group consisting of alkyl pyridinium halides, organic sulfates, and sulfonates; and distearyl dimethyl ammonium methylsulfate.

27. A method of imaging in accordance with claim 20 wherein the charge enhancing additive for the toner is distearyl dimethyl ammonium methylsulfate.

28. A method of imaging in accordance with claim 20 wherein the polymer mixture selected is comprised of from about 40 percent by weight to about 60 percent by weight of the first polymer, and from about 60 percent by weight to about 40 percent by weight of the second polymer.

29. A method of imaging in accordance with claim 20 wherein the image is affixed at a temperature of from about 300° to about 450° F.

30. A developer composition in accordance with claim 1 wherein the polymer mixture is selected from the group consisting of polyvinylidene fluoride with polyethylene, polymethylmethacrylate, and copolyethylene vinyl acetate; copolyvinylidene fluoride, tetrafluoroethylene, and polyethylene; polymethylmethacrylate and copolyethylene vinyl acetate; and polymethylmethacrylate and polyvinylidene fluoride.

31. A developer composition in accordance with claim 3 wherein the polymer mixture is selected from the group consisting of polyvinylidene fluoride with polyethylene, polymethylmethacrylate, and copolyethylene vinyl acetate; copolyvinylidene fluoride, tetrafluoroethylene, and polyethylene; polymethylmethacrylate and copolyethylene vinyl acetate; and polymethylmethacrylate and polyvinylidene fluoride.

32. A developer composition in accordance with claim 11 wherein the polymer mixture is selected from the group consisting of polyvinylidene fluoride with polyethylene, polymethylmethacrylate, and copolyethylene vinyl acetate; copolyvinylidene fluoride, tetrafluoroethylene, and polyethylene; polymethacrylate and copolyethylene vinyl acetate; and polymethylmethacrylate and polyvinylidene fluoride.

33. A developer composition in accordance with claim 19 wherein the polymer mixture is selected from the group consisting of polyvinylidene fluoride with polyethylene, polymethylmethacrylate, and copolyethylene vinyl acetate; copolyvinylidene fluoride, tetrafluoroethylene, and polyethylene; polymethylmethacrylate and copolyethylene vinyl acetate; and polymethylmethacrylate and polyvinylidene fluoride.

34. A method of imaging in accordance with claim 20 wherein the polymer mixture for the carrier is selected from the group consisting of polyvinylidene fluoride with polyethylene, polymethylmethacrylate, and copolyethylene vinyl acetate; copolyvinylidene fluoride, tetrafluoroethylene, and polyethylene; polymethylmethacrylate and copolyethylene vinyl acetate; and polymethylmethacrylate and polyvinylidene fluoride.

35. A method of imaging in accordance with claim 24 wherein the polymer mixture for the carrier is selected from the group consisting of polyvinylidene fluoride with polyethylene, polymethylmethacrylate, and copolyethylene vinyl acetate; copolyvinylidene fluoride, tetrafluoroethylene, and polyethylene; polymethylmethacrylate and copolyethylene vinyl acetate; and polymethylmethacrylate and polyvinylidene fluoride.

* * * * *